US005850995A

United States Patent [19]

Lin

[11] Patent Number: 5,850,995

[45] Date of Patent: Dec. 22, 1998

[54] CLOCK STAND

[76] Inventor: Mei-Yen Lin, 308, Section 3, Chung Yang Road, Long Chin Hsiang, Taichung Hsien, Taiwan

[21] Appl. No.: 926,791

[22] Filed: Sep. 10, 1997

[30] Foreign Application Priority Data

Mar. 12, 1997 [CN] China ..... 85217578A01

[51] Int. Cl.[6] ..... A47F 7/00

[52] U.S. Cl. ..... 248/116; D10/128; 368/223

[58] Field of Search ..... 248/114, 115, 248/116; 403/217, 218, 170, 174, 381; D10/128; 368/223

[56] References Cited

U.S. PATENT DOCUMENTS 3,062,491 11/1962 Green ..... 248/116
3,191,901 6/1965 Green ..... 248/116
3,554,236 1/1971 Rhodes ..... 403/381 X
4,652,170 3/1987 Lew ..... 403/217 X
5,114,265 5/1992 Grisley ..... 403/381

*Primary Examiner*—Ramon O. Ramirez
*Attorney, Agent, or Firm*—Harrison & Egbert

[57] ABSTRACT

A clock stand is formed of a base body including of a plurality of base sides, which are arranged continuously such that they form a plurality of positive or negative equipotential angles of 120 degrees so as to make the clock stand versatile in form. The base sides are provided respectively with a projected shaft member and a recessed seat engagable with the projected shaft member in corporation with a base block.

4 Claims, 8 Drawing Sheets

CLOCK STAND

FIELD OF THE INVENTION

The present invention relates generally to a clock, and more particularly to a stand of the clock.

BACKGROUND OF THE INVENTION

There are a variety of conventional clock stands available in the market today. These conventional clock stands are rather monotonous in design and are therefore less appealing to the consumers at large.

SUMMARY OF THE INVENTION

The primary objective of the present invention is to provide a clock stand which is versatile in design so as to enhance its marketability.

In keeping with the principle of the present invention, the foregoing objective of the present invention is attained by a clock stand includes a plurality of base sides forming a base body. The base sides are arranged continuously such that they form the positive or negative equipotential angle of 120 degrees, and that the clock stand has a versatile design.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
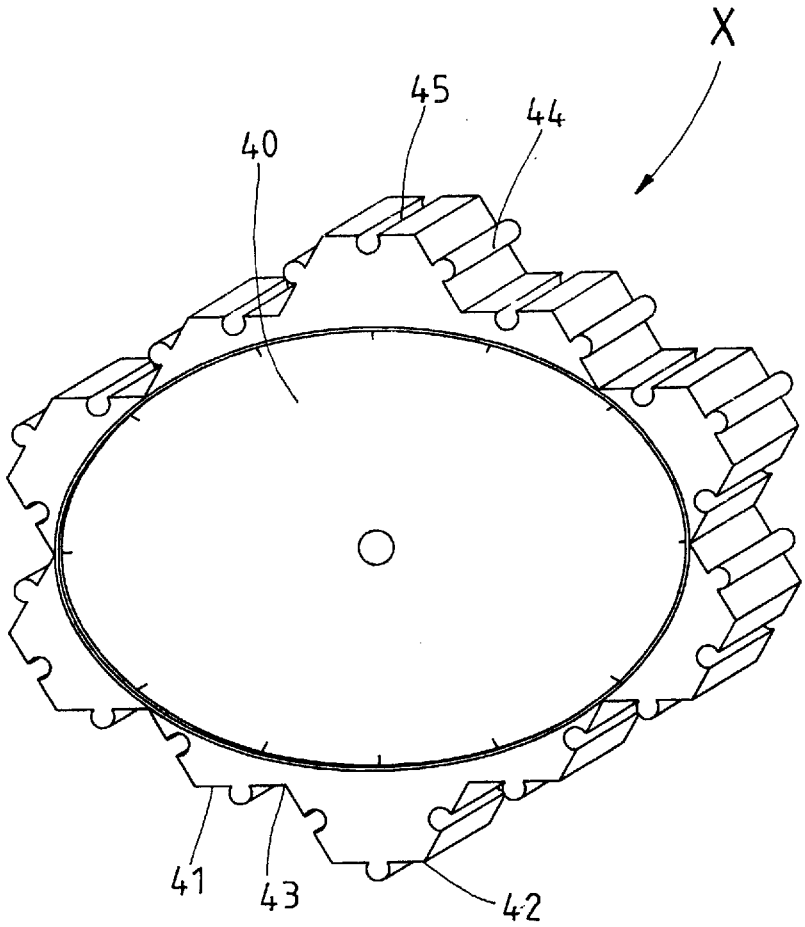
FIG. 1 shows a perspective view of an X base body of the present invention.
Figure 2:
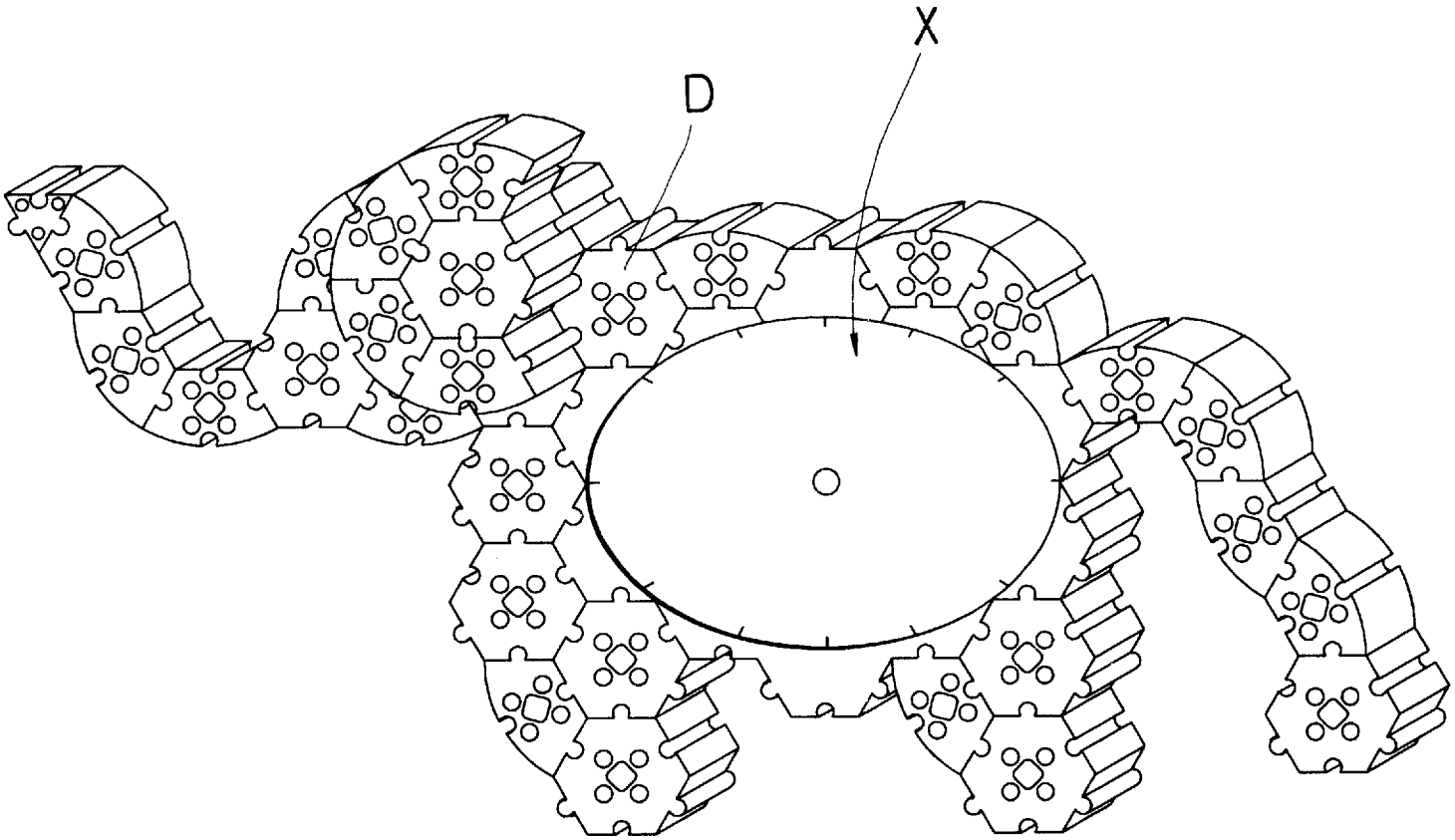
FIG. 2 shows another perspective view of the X base body of the present invention.
Figure 3:
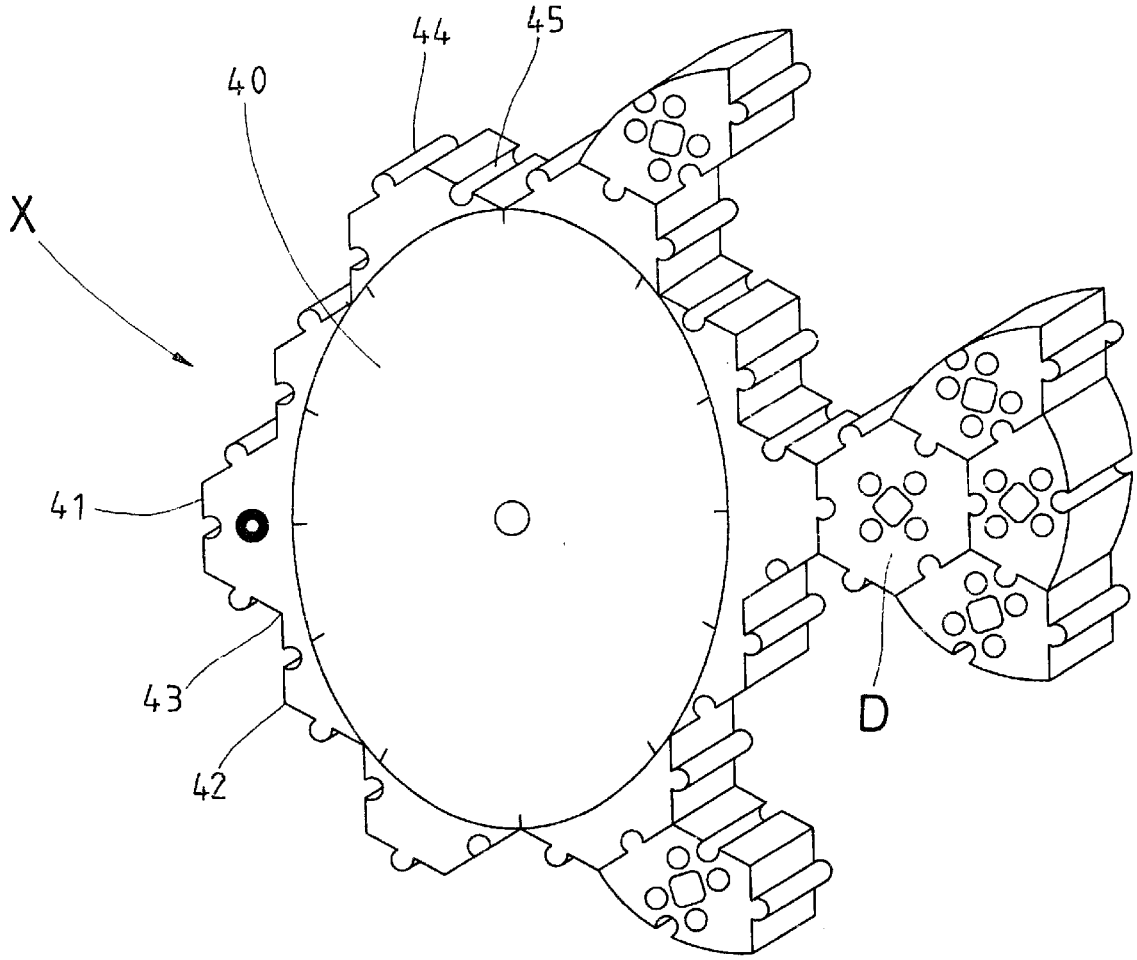
FIG. 3 shows still another perspective view of the X base body of the present invention.

As shown in FIGS. 1–3, a clock stand of the present invention is composed of an X base body for supporting a clock 40. The X base body is formed of a plurality of base sides 41 which are equal in length to one another and are arranged continuously to form a plurality of positive equipotential angles 42 of 120 degrees or negative equipotential angles 43 of 120 degrees. The angles 42 and 43 are arranged continuously or alternately. If the angles 42 or 43 are arranged continuously, they should not exceed five in number, so as to allow the base sides 41 of the X base body to expand freely. The base sides 41 are provided respectively at the center thereof with a projected shaft member 44 and a recessed seat 45 engageable with the projected shaft member 44 in cooperation with a base block D, as shown in FIGS. 2 and 3.

Figure 4:
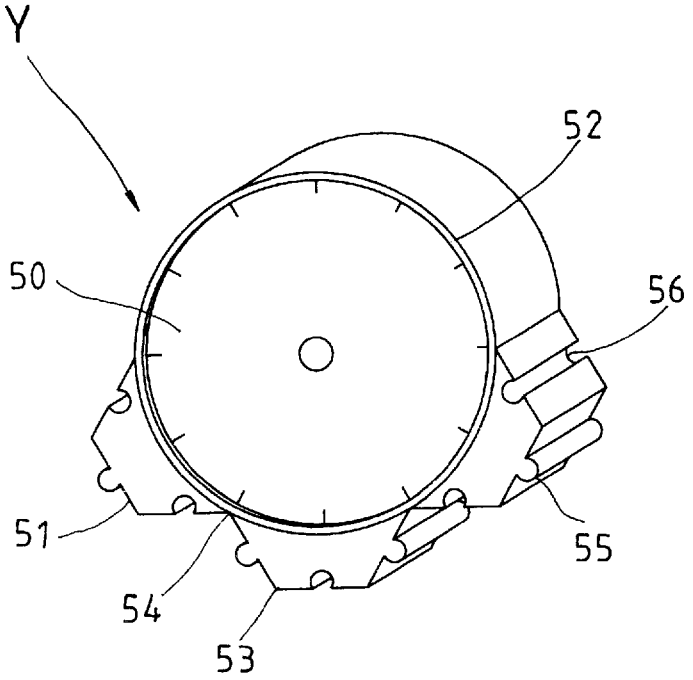
FIG. 4 shows a perspective view of a Y base body of the present invention.
Figure 5:
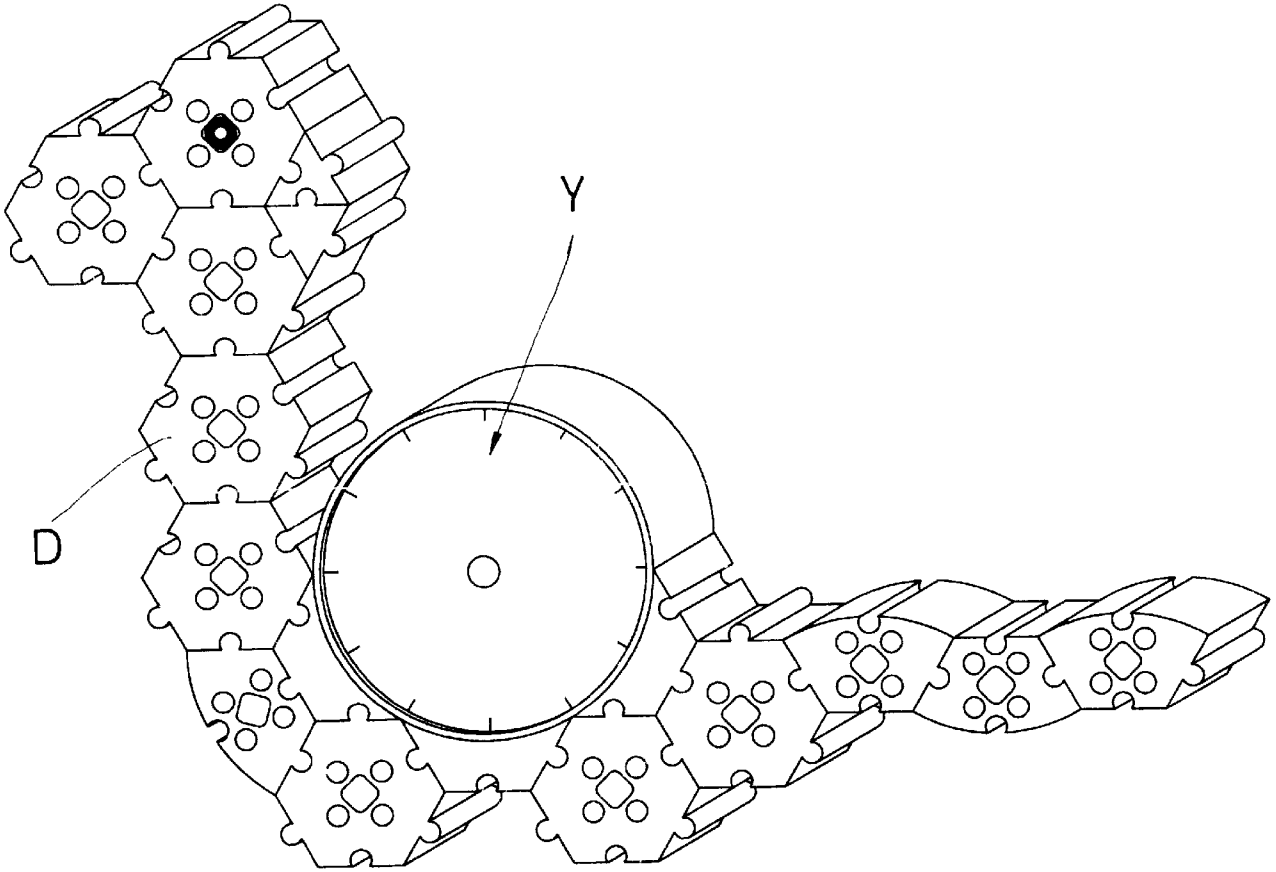
FIG. 5 shows a schematic view of the Y base body of the present invention.
Figure 6:
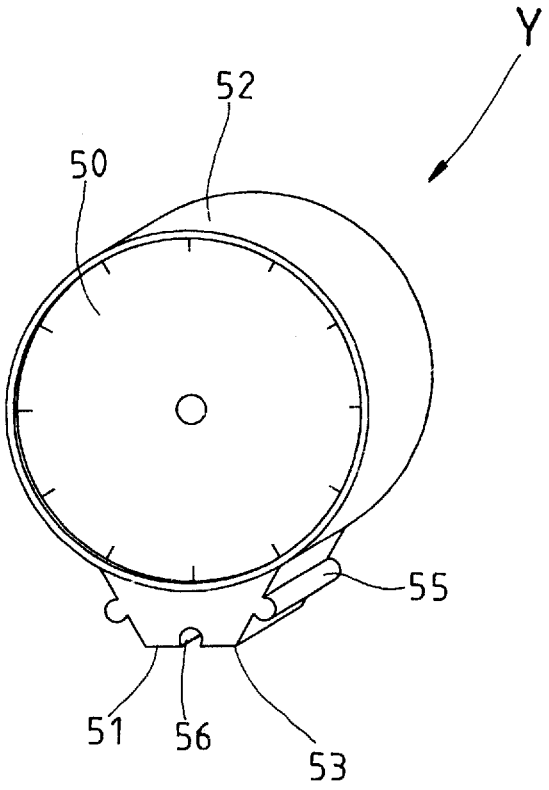
FIG. 6 shows a perspective view of another Y base body of the present invention.
Figure 7:
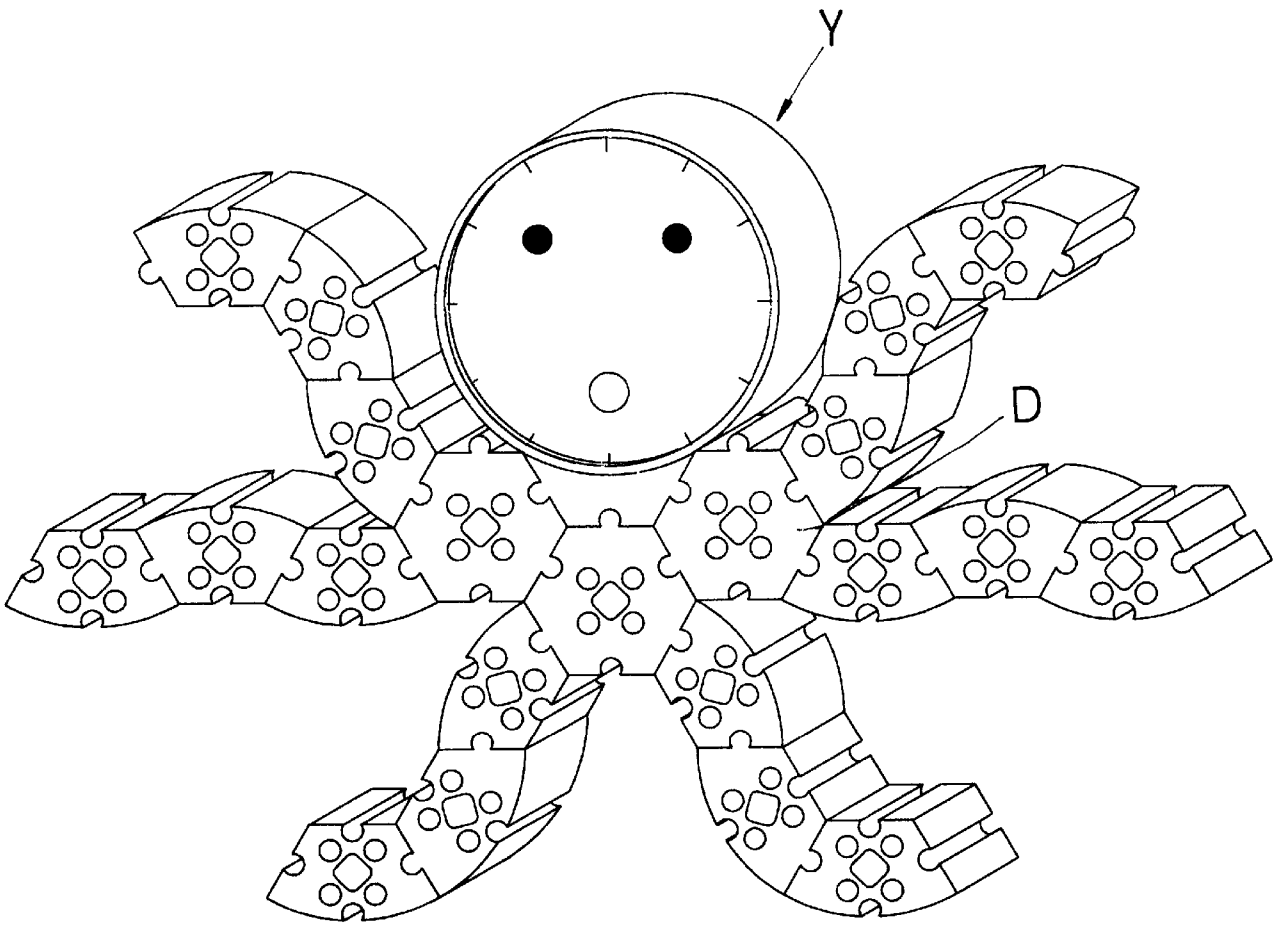
FIG. 7 shows a schematic view of another Y base body of the present invention.
Figure 8:
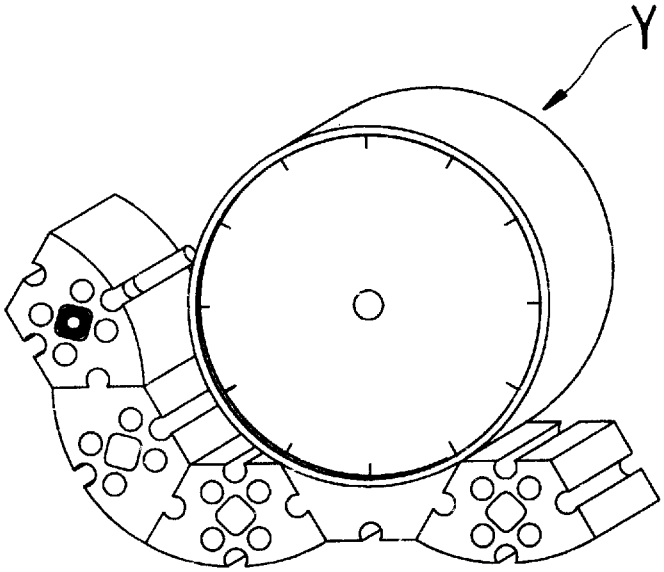
FIG. 8 shows still another schematic view of another Y base body of the present invention.

As shown in FIG. 4, a base body Y is formed of a plurality of base sides 51 of equal length in conjunction with a plurality of base sides 52 of a specific form. The base sides 51 are arranged continuously to form a plurality of positive equipotential angles 53 or negative equipotential angles 54. No more than five positive equipotential angles 53 or negative equipotential angles 54 can be arranged continuously. The base sides 51 are provided respectively at the center thereof with a projected shaft member 55 and a recessed seat 56 engageable with the projected shaft member 55 in cooperation with a D base block, as shown in FIG. 5. The clock 50 stand is formed of the base body Y of various forms, as shown in FIGS. 6, 7 and 8.

The embodiments of the present invention described above are to be deemed in all respects as being merely illustrative and not restrictive. Accordingly, the present invention may be embodied in other specific forms without deviating from the spirit thereof. The present invention is therefore to be limited only by the scope following appended claims.

What is claimed is:

1. An apparatus comprising:

a clock;

a base body supporting said clock, said base body being formed of a plurality of base sides which are equal in length to one another, said plurality of base sides being arranged continuously to form a plurality of positive or negative equipotential angles of 120 degrees, said base sides being provided respectively with a projected shaft member; and a base block having a recessed seat engageable with said projected shaft member of said base body.

2. The apparatus as defined in claim 1, wherein no more than five of said positive or negative equipotential angles are arranged continuously.

3. An apparatus comprising:

a clock;

a base body supporting said clock, said base body being formed of a plurality of base sides of equal length and a plurality of base sides of a specific length, said base sides of equal length being arranged continuously to form a plurality of positive or negative equipotential angles of 120 degrees, said base sides of equal length being provided respectively with a projected shaft member and a recessed seat; and a base block having a projected shaft member engageable with said recessed seat of said base body.

4. The apparatus as defined in claim 3, wherein no more than five of said positive or negative equipotential angles are arranged continuously.

* * * * *